US006634574B1

(12) United States Patent
Eisfeld

(10) Patent No.: US 6,634,574 B1
(45) Date of Patent: Oct. 21, 2003

(54) METHOD AND DEVICE FOR OBTAINING VEGETAL FIBRE MATERIAL AND THE USE THEREOF

(75) Inventor: Jens-Gerrit Eisfeld, Tennenbachstrasse 4, D-79106 Freiburg (DE)

(73) Assignee: Jens-Gerrit Eisfeld, Freiburg (DE)

( * ) Notice: Subject to any disclaimer, the term of this patent is extended or adjusted under 35 U.S.C. 154(b) by 0 days.

(21) Appl. No.: 09/762,254

(22) PCT Filed: Aug. 9, 1999

(86) PCT No.: PCT/DE99/02477

§ 371 (c)(1),
(2), (4) Date: Feb. 5, 2001

(87) PCT Pub. No.: WO00/08240

PCT Pub. Date: Feb. 17, 2000

(30) Foreign Application Priority Data

Aug. 7, 1998 (DE) ..... 198 35 771

(51) Int. Cl.[7] ..... B02C 19/12

(52) U.S. Cl. ..... 241/5; 241/19; 241/23; 241/29; 241/57; 241/60; 241/79.1; 241/176

(58) Field of Search ..... 241/1, 5, 39, 301, 241/19, 23, 79.1, 65, 57, 29, 171, 172, 60, 176; 536/128

(56) References Cited

U.S. PATENT DOCUMENTS

| | | | | |
|---|---|---|---|---|
| 2,362,965 A | | 5/1942 | Berkman | |
| 3,775,953 A | * | 12/1973 | Poutsma | 56/126 |
| 5,040,270 A | | 8/1991 | Mackey | |
| 5,759,463 A | | 6/1998 | Chang | |

FOREIGN PATENT DOCUMENTS

| | | |
|---|---|---|
| DE | 183 923 | 5/1906 |
| DE | 23 37 227 | 2/1995 |
| EP | 0 599 088 | 6/1994 |
| WO | WO 97 21 734 | 6/1997 |

* cited by examiner

*Primary Examiner*—Mark Rosenbaum
(74) *Attorney, Agent, or Firm*—Paul Vincent

(57) ABSTRACT

A low-fiber method for obtaining a fiber material (21) that is suitable for use as a raw material for insulation purposes, for the production of fiber mattresses or as a filing or padding material, from the fruits of poplars, willows, composites or similar plants. The closed fruits of said plants are dried and/or opened using an air flow and agitated in a treatment chamber (17), whereby the fiber material (21) contained in the fruit capsules (19) is substantially separated from the other constituent parts of said fruits.

31 Claims, 4 Drawing Sheets

METHOD AND DEVICE FOR OBTAINING VEGETAL FIBRE MATERIAL AND THE USE THEREOF

BACKGROUND OF THE INVENTION

The invention relates to a method and device for obtaining fibre material for the obtaining of a fibre material suitable for use as a raw material for insulation purposes or for the manufacture of non-wovens or as a padding or filling material, and the use thereof.

The principle is known of manufacturing insulating materials, filling or padding materials, or non-woven materials of this nature for insulation purposes in bed covers, sleeping bags, or the like. The known raw materials can be, for example, cotton, animal products, or plastics.

The cultivation of cotton plants is carried out as an intensive agricultural activity as a monoculture with, in most cases, considerable use of pesticides. For this reason, agricultural cultivation areas and their surroundings are subjected to heavy environmental burden and damage.

The obtaining of a raw material from animal products requires in part animal husbandry on a considerable scale, since the animal products are manufactured from duck and geese down and feathers.

The use of plastics, such as foamed materials, as insulation or filling materials, has the disadvantage that these plastics only breathe to a limited extent and in part give rise to possibly unhealthy emanations.

To manufacture insulation and filling materials or non-wovens, recourse is made, for example, to cotton fibres. It is well-known that cotton harvesting and cotton gin machinery are used to harvest and acquire plant fibres from the blossom of cotton plants. With the aid of these machines cotton bolls which have already opened are cut off and gathered in. The fibres are as a rule acquired in such a way that the pods which have already been emptied are also gathered. The fibres are then separated from the seeds of the cotton plants by mechanical ginning and centrifugal methods.

From DE 183 923 a machine is known for the gathering of fibres remaining adherent to the cotton seed pods, in which striker elements of the machine strike against the material to be processed with considerable force. A linting-ginning machine known from DE 23 37 227 A1 is intended for further processing of cotton seeds and the lint (short-staple cotton) adhering to them, in which the long-staple cotton is separated from the seeds beforehand by means of a ginning machine. The linting-ginning machine in question uses for this purpose, inter alia, a drum, which is clad on the inside with abrasive material.

The principal is further known from U.S. Pat. No. 5,040,270 of drying and cleaning the harvested fibres, already separated from boll pods, by means of heated air.

The objective on which the invention is based is, instead of the known methods of acquiring cotton fibres, of developing a simple and effectively applied acquisition of a vegetal or plant fibre material which handles the fibres as gently as possible.

This objective is achieved in accordance with the features of the independent claims.

SUMMARY OF THE INVENTION

Accordingly, the invention according to the independent method claim consists of a method for the acquisition of a fiber material suitable for use for insulation purposes or for the manufacture of non-woven materials, or as a filler or padding material, from the fruits of poplars, willows, composites or similar plants, with the use of which closed fruits of poplars, willows, composites or similar plants are dried and/or opened in a treatment process by means of an air flow in such a way, and are moved in a treatment chamber in such a way, that the fiber material contained in the fruit pods is largely released from the remaining constituents of the fruits.

The term "fruits" is to be understood in this case not as the botanical-scientific term, but rather as the fruit pods, seed pods, and possibly also illusory fruits, which can be harvested as one unit from the plant (as far as possible in a largely or wholly closed state), which on opening, in accordance with the method according to the invention, release the fibres and seeds, whereby the fibres are largely separated from the seeds by the method according to the invention.

By means of the solution according to the invention, a substitution of the known insulating or filling materials is possible, in that a natural plant material native to Central Europe and other regions of the world can be acquired with the same or improved quality features. During cultivation and acquisition, it is possible to do away with monocultures requiring the use of pesticides and the agricultural investment, as well as with long hauling distances. The method is suitable, inter alia, for the seed hairs and the adherent elements to assist in the flight of the seeds of different species of poplar or willow (Salicacae) as well as composites (Asteracaea) and epilobium types.

Attention is drawn to the fact that the seeds do not necessarily have to be separated entirely from the seed hairs, since they can also be finally released and fall through in a subsequent further processing procedure in carding machines.

The fruits of the Salicacea cannot be harvested from the tree with existing machines, nor does the white tuft material of the fruits (seed hairs, floating appendages for flight-dispersal of the seeds) remain attached to the fruit pods after the pods have opened, because the adherent elements will already be carried off by a light wind.

The striker elements of the machine according to DE 183 923 would cause the contamination/discolouration of the fibres due to coloured plant constituents and/or the contamination of the fibres by vegetable oil due to the crushing of the seed pods. It is also of significance that the striker elements have an extreme mechanical effect on the plant fibres, which results in a clear reduction in the quality of the raw fibre material acquired. This applies in particular to the seed and fruit hairs of the plants particularly under consideration with regard to the invention, which feature a substantially finer fibre cross-section and which therefore react to mechanical effects in a more sensitive manner. It is therefore a main objective of the method according to the invention to exert no mechanical effect, or as little mechanical effect as possible on the fibres to be acquired.

With a rational harvesting of the fruit pods of poplar or willow by mechanical methods, it is only possible with additional effort to harvest the fruits separately from the seed spindles, fine stems, and leaves. This is however avoided by the solution according to the invention, in that the fruits, which have still not opened, are sawed-off with the branches from the trees, and coarser branches are then separated from the finer branches on which the fruit hangs. The harvested material with the fruits not yet opened is filled into a container for drying. By the admission of a hot air flow, the fruit pods can be dried and ripened and induced to open.

After opening, fibre material and seeds are exposed. Seeds and fibre material are separated by the material being impacted onto itself, and by striking the walls of the container, as well as by means of air turbulences. This effect can be amplified by additional media located in the container, such as rotating paddles, mixing elements, wooden spheres, or the like. Powerful impacting by mechanical impact elements, however, does not take place.

In an optimum sequence of the method, one single cycle is sufficient for the fruit pods to be opened, separated from the residual constituents of the material introduced, and floating appendages are separated from the seeds. Because branches and leaves may also be filled into the container together with the fruit pods, the plants which are to be plucked cannot have the foliage stripped by artificial means.

In a preferred embodiment of the method, the harvested material is thoroughly pretreated, in that it is stored for one or two days at high air humidity (the material's inherent moisture and possible condensation moisture are in general sufficient for this purpose), in order to initiate the process of releasing the seeds from the seed hairs in a manner which will not damage the fibres and without any mechanical effects.

In a preferred embodiment of the method, the harvested material is thoroughly pretreated, in that is watered for several days in order to initiate the process of releasing the seeds from the seed hairs in a manner which will not damage the fibres and without any mechanical effects.

In a preferred embodiment of the method, the harvested material is thoroughly pretreated, in that is deep-frozen before being filled into the device, in order to promote the process of detaching the seeds from the seed hairs.

In a preferred embodiment of the method, the harvested material is thoroughly pretreated in that, before being filled into the device, it is pretreated by at least initial fermentation and/or milling (mechanical exertion of pressure on the closed pods).

In a preferred embodiment of the method, the harvested material is thoroughly pretreated in that, before being filled into the device, it is broken up by powerful shaking.

In a preferred embodiment, the air flow carries the fibre material to a separation chamber, whereby the air flow in the separation chamber is reduced and the fibre material is caught, for example in a net (catchment net). The air flow carries the fibre material out of the treatment chamber of the container and conducts it to the separation chamber. In the separation chamber the air flow loses a considerable part of its eroding force. As a result, the heavy particles carried along in the air flow, such as seed kernels and smaller fruit pod fragments, may be deposited on the floor of the separation chamber. These can likewise be separated by means of screening techniques or other separation methods. The substantially lighter floating appendages are carried out through an outlet in the separation chamber by the air flow, which has become much weaker. The air flow carrying the floating appendages then conducts these elements to the net, the mesh width of which corresponds approximately to that of a mosquito net. The air can escape, while the floating appendages are caught.

To accelerate the harvesting process, branch material bearing fruits is brought into the treatment chamber. The branch material can be bent off, scraped off, and/or hacked off from the coarse branches before being filled into the container. The cutting of the fruit pods into small pieces during hacking does not cause a problem. Speeding up of the separation process can be achieved by the chamber moving or featuring a moving internal arrangement (drum insert).

Movement of the constituent parts which will promote their separation can be achieved by the container or a container insert element being arranged horizontally, and rotated about the longitudinal axis of the container.

In a preferred embodiment of the method, the separation of the seeds from the seed hairs is enhanced in that filler substances are used in the rotating drum, which drop onto the seed hairs connected to the seeds. The use of filler substances with surfaces which are not hard, or which are in fact soft, permits extensive protection of the fibres. In particular, with embodiments according to the invention, additional light filling material with hard surface is used in the rotating drum, depending on the type of plant. To further advantage, additional cork granulates can be used in the rotating drum.

With methods according to the invention, additional cereal grains, corn-cob residue/internal elements, acorns, chestnuts, wood chippings, bark chippings, slivers, broken chips, limestone grit (crushed limestone), lightweight minerals, such as swelling clay or tufa or similar filler materials can be used.

In a preferred embodiment of the device, the separation chamber is considerably larger (in one example, twice as wide) in the horizontal than in the vertical direction. This results in the advantage that the contaminated material, when precipitating, no longer impedes the pure fibre material in suspension, since the two fractions which are to be separated already flow along separate paths from the moment of emerging from the connection channel leading to the separation chamber.

The fibre caught in the catchment net can optionally be further processed in order to manufacture insulating materials, filling materials, papers, and body paddings or coverings and/or non-woven materials at least partially from the fibre material. The fibre material is suitable for persons allergic to bird feathers and animal hair.

In one embodiment of the device, instead of the separation chamber with catchment device, a cyclone separator is provided for, by means of which the lightweight seed hairs are separated from the heavy contaminants. This embodiment, however, is not very gentle to the fibres from the present perspective.

With the method and device, at least two of the features of the method and device referred to heretofore can be combined.

Further features and advantages of the invention can be derived from the following description of embodiments of the invention on the basis of the drawings, which show essential features of the invention, and from the claims. The individual features can be realised each independently or in the form of several features in combination in an embodiment of the invention.

DESCRIPTION OF THE PREFERRED EMBODIMENT

Figure 1:
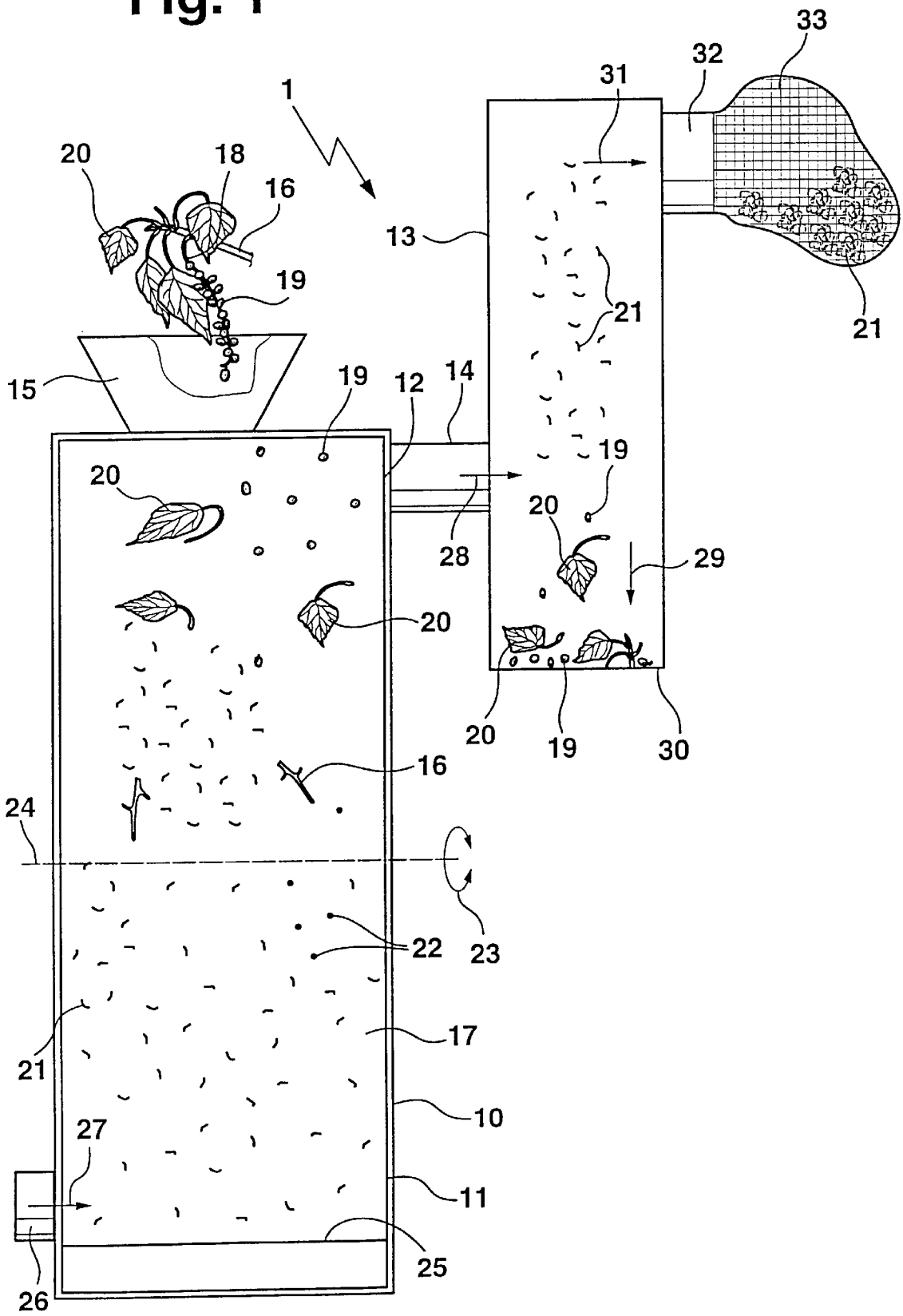
FIG. 1 shows a schematic side view of a device for the performance of a method for the obtaining of fibre material from fruit pods from poplars, willows, composites, or similar plants.

The invention is represented in schematic form in the drawing, so that the essential features of the invention can be easily identified. The representation is not necessarily to be regarded as being to scale.

It can be seen from FIG. 1 that a device 1 for carrying out the method comprises a container 10 with a drum insert 11. An outlet 12 of the container 10 is connected to a separation chamber 13, so that the container 10 features a passage through to the separation chamber 13. Connected to the outlet 12 is a connection channel 14, which in the embodiment shown runs in a straight line, but in other embodiments can be designed in spiral fashion. With the aid of an inlet 15, the container 10 can be filled with fine branches 16, so that an inhomogeneous amount of material can be moved in a treatment chamber 17 of the container 10. Fine twigs 16 are conducted to the treatment chamber 17, the fruit pods 19 of which, located on twigs 18, have not opened yet. The inhomogeneous material of the treatment chamber 17 is composed of fine branches 16, fruit pods 19, leaves 20, buds, seed hairs 21 and seed kernels 22.

The drum insert 11 is arranged in a horizontal direction (i.e. with a horizontal axis of rotation 24), and can rotate in the direction of the arrow 23 about the axis of rotation 24 of the container 10. At least one shoulder element, wing, or carrier dog 25, formed at the edge of the drum insert 11, raises the inhomogeneous material at each rotation.

By means of an inlet nozzle 26, heated air can be conducted into the treatment chamber 17 in the direction of the current 27. The inflow of air leads on the one hand to a drying process of the fruit pods 19, which are opened as a result, and expose the seeds with the seed hairs. On the other hand, the fruit pods 19 are mixed up with one another in eddy fashion in connection with the movement of the drum insert 11 in the treatment chamber 17. This contributes to the loosening and/or release of the seed hairs 21 from the seed kernels 22.

The seed hairs 21 are blown by the air flow in the direction of flow 28 out of the treatment chamber 17 into the separation chamber 13. In addition to the seed hairs 21, parts of other foreign bodies may also pass into the separation chamber 13. The air flow is weakened on entry into the separation chamber 13, with the result that only the seed hairs 21 can be moved by the air flow in the separation chamber 13. The air flow is weakened because the flow cross-section of the separation chamber 13 is greater than that of the connection channel 14, as shown in the drawing.

The foreign bodies which are to be separated from the seed hairs 21 by the method, such as, for example, leaves 20 and fruit pod constituents 19, fall into the separation chamber 13 downwards in the direction of the arrow 29, and are deposited on the floor 30 of the separation chamber 13, because the air flow is no longer powerful enough to move them. The seed hairs 21, by contrast, are conducted in the direction of the flow 31 via an outlet nozzle 32, to a catchment net 33. The outlet nozzle 32 is located opposite the connection channel 14 in an elevated position, to ensure that foreign bodies cannot pass into the outlet nozzle 32.

The catchment net 33 is fine-meshed, comparable to a mosquito net. The seed hairs 21 can collect in the catchment net 33. The catchment net 33 is connected in a releasable manner to the outlet nozzle 32, so that the collected seed hairs 21 can be conducted onwards for further processing as fibre material for filling or insulating materials.

The container 10 and the separation chamber 13 are arranged by way of example for the performance of the method. In other embodiments according to the invention, instead of the separated container 10 and the separation chamber 13, a container of a device can be used, which in one embodiment has several treatment chambers arranged one behind another.

In a preferred embodiment of the method/device, the drying temperature in the drum insert 11 is kept so low that the pods only open slowly. The suitable temperature may differ depending on the type of plant. At the same time, the revolution speed of the drum insert 11 is maintained sufficiently high for the harvested material with the pods still closed to be frequently raised and dropped onto the floor of the drum insert. As a result, the connection between the seeds and the seed hairs will be loosened or released. The seed hairs 21 which are already released and the seed hairs which are still loosely connected to the seeds are conducted out of the drum insert by an air flow maintained at a suitably high strength, before they are covered over by the harvested material, as frequently occurs, and are thus impaired in their fibre quality.

Figure 2:
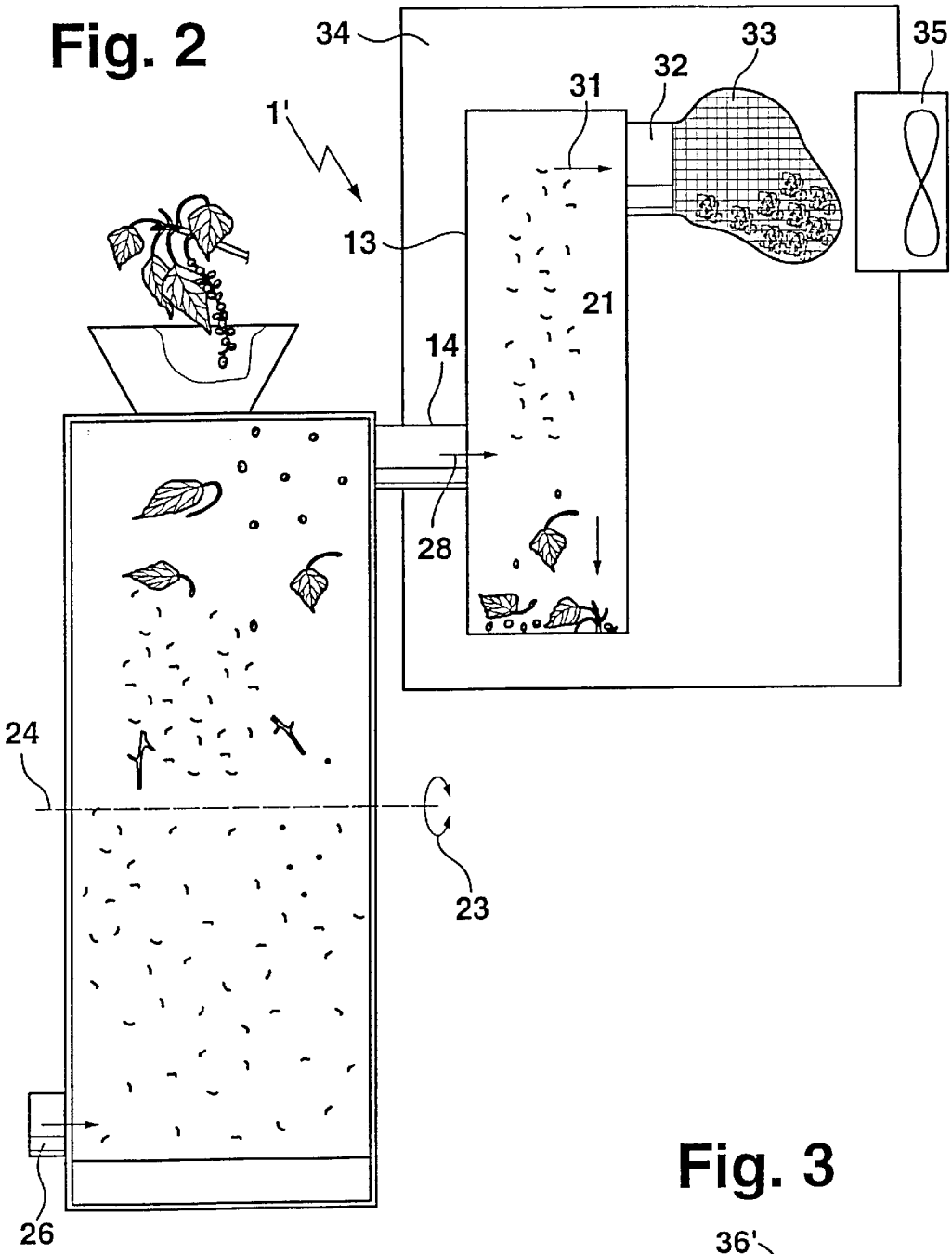
FIG. 2 shows an embodiment with a suction extraction fan.

FIG. 2 shows an embodiment of the invention which provides particularly gentle treatment for the fibres, according to which a fan is located behind the catchment device to function as a suction extraction blower 35, whereby the catchment device is located in an enclosed space 34.

Figure 3:
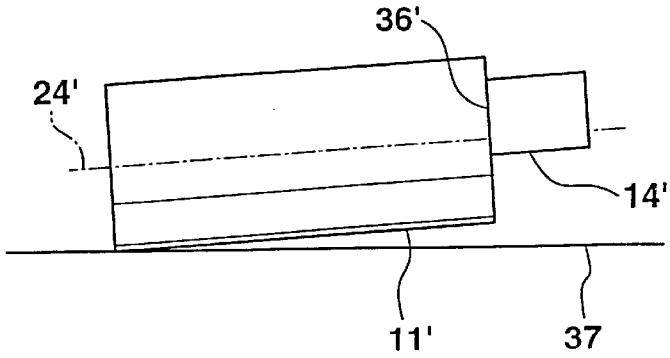
FIG. 3 shows an embodiment with a drum arranged inclined slightly against the horizontal plane.

FIG. 3 shows a preferred embodiment of the method/device. In this situation the axis of rotation 24' of the drum insert 11' is not located in a fully horizontal position, but in a position inclined at an angle of a few degrees to the horizontal plane 37. The result of this is that harvested material which has not been opened remains closer to the heating system, while the light fibre material is already being moved in the direction of the connection channel 14'. The advantage in this situation is that contaminated material which is taken up in the eddy current does not pass with such force into the connection channel 14', as a result of which better preliminary decontamination is achieved. In addition to this, this also allows for the suction surface 36' of the connection channel 14' to be enlarged and the blowing capacity of the suction device to be increased. A further advantage derives from the fact that the seed hairs which are released are no longer subjected to such high temperatures as the harvested material which has not yet opened, and are therefore treated with additional gentleness with regard to the thermal effects. This also allows for thermal energy to be utilised more effectively.

Figure 4:
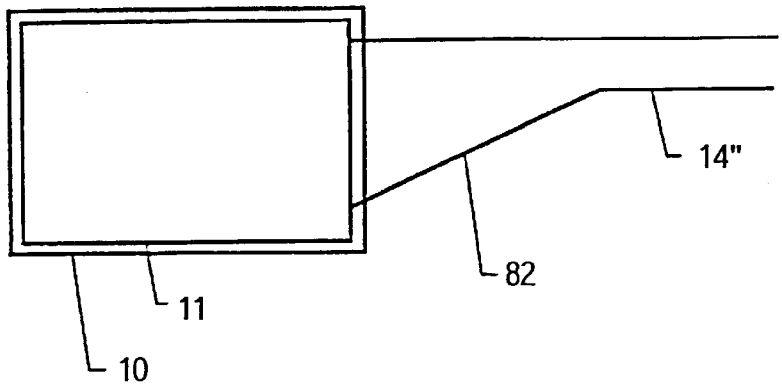
FIG. 4 shows a non-rotating transition piece.

FIG. 4 shows details of another preferred embodiment of the device. A non-rotating transition piece 82 is arranged between the container 10 and the connection channel 14", the diameter of which is somewhat smaller than that of the drum insert 11 and substantially larger than that of the connection channel 14". The effect of this is that, on the one hand, due to the greater diameter with the correspondingly reduced flow rate, more lightweight seed hairs and less contaminated material pass into the connection channel 14", as a result of which better preliminary decontamination and more effective suction extraction of the seed hairs is achieved, and, on the other hand, less contaminated material taken up by the eddy currents passes into the connection channel 14", as a result of which better preliminary decontamination is likewise achieved.

Figure 5:
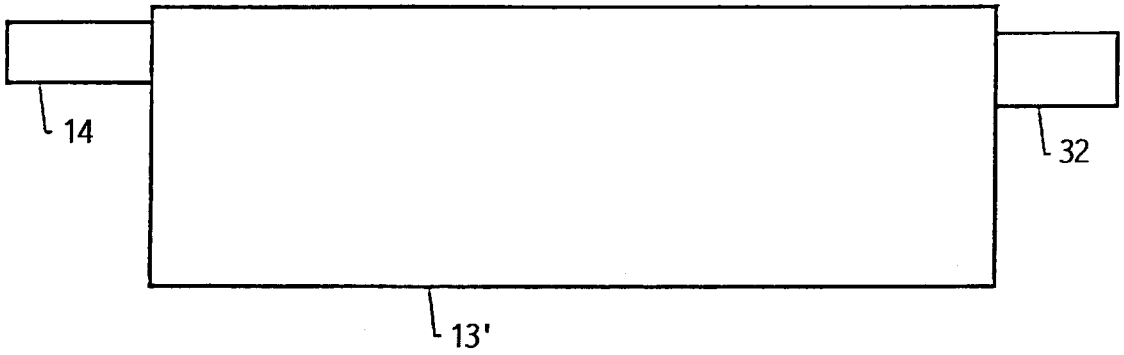
FIG. 5 shows a relatively long separation chamber.

FIG. 5 shows a relatively long separation chamber 13' arranged horizontally, in which the path of the fibres, which are moved by the flowing air, is separated at an early stage from the path of the other constituents of the fruit.

Figure 6:
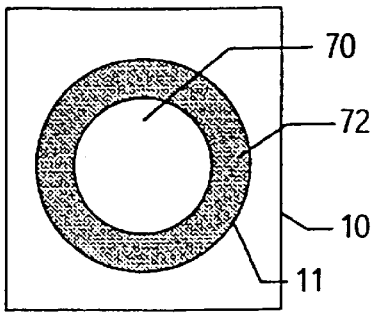
FIG. 6 shows a lateral face on the outlet side of a drum.

FIG. 6 shows a face wall of the drum 11 on the output side, which features a central aperture 70 with a circumferential unperforated edge 72, which prevents coarse particles from falling through.

Figure 7:
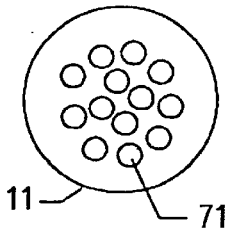
FIG. 7 shows a lateral face on the outlet side of another drum.

FIG. 7 shows an alternative form to FIG. 6, in which, instead of the central large aperture, perforation holes 71 are provided for. Here too, a non-perforated external area is provided for.

Figure 8:
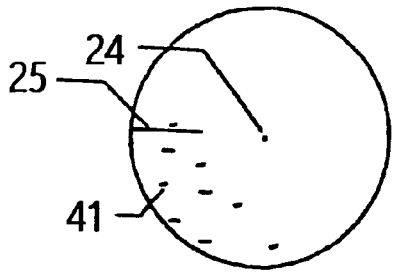
FIG. 8 shows a cross-section through a drum with carrier ribs or tines.
Figure 9:
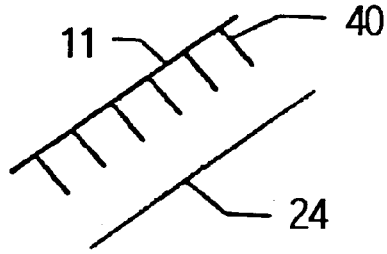
FIG. 9 shows the carrier tines from FIG. 8 in a plan view.

With the preferred embodiment shown in FIGS. 8 and 9, the carrier(s) 25 project, with fork-shaped projections or ribs 40 into the interior of the drum 11 in such a way that they allow the harvested material 41 which is to be opened to pour down from above, as a result of which effective utilisation of the drying air and better eddy circulation of the seed hairs can be achieved. These fork-shaped carrier ribs 40 are arranged on a plane at the edge of the drum along the axis of rotation 24.

Figure 10:
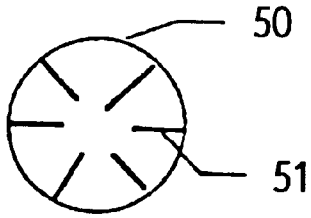
FIG. 10 shows a tube with flow obstacles in cross-section.

With the embodiment explained on the basis of FIG. 10, the material which has been drawn up by suction and subjected to preliminary decontamination is conducted, before being introduced into the separation chamber 13, into tubes 50, which are corrugated (i.e. the interiors are not smooth-walled) and/or which feature rough or uneven internal walls, for example in the form of rod-shaped obstacles 51. As a result of this, seeds which are still connected to the hairs are separated from them due to impact against the obstacles, while the hairs which have already been released are swept on the air flow past the obstacles because of their lightness (or their different specific weight). As a result of this, the utilisation of the harvested material and the purity of the fibrous material, i.e. the efficiency of the method, is increased in a manner such as to provide more gentle processing.

In a preferred embodiment of the method/device, the material which is sucked up after undergoing preliminary decontamination is conducted, before introduction into the separation chamber 13, into tubes in which, for example by means of a course of the tube in the form of a curve or spiral staircase and/or due to sudden changes of direction and/or due to sudden changes of diameter, eddy currents of the air flows are created. As a result of this, seeds which are still connected to the seed hairs are separated from the hairs.

The methods involved with any preliminary treatment, with the opening of the fruit pods, and with the decontamination, are to the purpose very finely adjusted to the conditions of the individual seed fibre plants in each case and to their degree of ripeness.

The method serves the purpose of harvesting and obtaining a fibre material (21), formed from fruits of poplars, willows, composites or similar plants, suitable for use as a raw material for insulation purposes or for the manufacture of non-wovens or as filling or padding material. With the use of the method, closed fruits of poplars, willows, composites or similar plants are dried and opened in a treatment chamber (17) of a device (1) by means of an air flow, and are moved in the treatment chamber (17) in such a way that the fibre material (21) contained in the fruit pods (19) is released from the other constituent parts of the fruit. Instead of the obtaining of cotton fibres, a method has been developed for the obtaining and utilisation of another plant fibre material, with the gentlest possible treatment of the fibres and which is easy to implement. The method can also to obtain cotton or kapok.

Attention is expressly drawn to the fact that it is not necessarily seed-free material only which can be obtained with the methods referred to, since the possibility also pertains of gentle subsequent treatment by means of known carding methods/carding machines or other machines. The most important feature of the methods and method combinations referred to is that the fibres can be obtained in a substantially more gentle manner than with previously known ginning methods, and for the first time allows to obtain very fine fibres.

I claim:

1. A method for obtaining a fiber material suitable as a raw material for insulation purposes and for the manufacture of non-woven materials, the method comprising the steps of:

a) introducing fruit pods of at least one of poplar, willow, fruit hair developing plants, Bombacacea, cotton, cotton-type epilobium strains, fruits having hairy outgrowths from inner walls thereof, composites, and all other seed hair containing plants into a treatment chamber;

b) flowing air through said treatment chamber to dry said fruit pods; and c) moving said fruit pods in said treatment chamber to substantially release fiber material from other constituents, wherein initially closed fruit pods open to expose fiber material contained therein.

2. The method of claim 1, further comprising conducting, by means of air flow, said fiber material to at least one separation chamber, reducing air flow in said separation chamber, and catching said fiber material.

3. The method of claim 2, further comprising guiding air flow in a spiral fashion between said treatment chamber and said separation chamber.

4. The method of claim 1, wherein branch material bearing said fruit pods is introduced into said treatment chamber.

5. The method of claim 4, wherein said branch material is chopped prior to introduction into said treatment chamber.

6. The method of claim 1, wherein, prior to step a), the fruit pods are stored for one or two days in air having high humidity to enhance subsequent release of seeds from seed hairs in step c).

7. The method of claim 1, wherein, prior to step a), the fruits pods are watered for several days to enhance release of seeds from seed hairs in step c).

8. The method of claim 1, wherein, prior to step a), the fruit pods are subjected to a preliminary thermal treatment.

9. The method of claim 1, wherein, prior to step a), the fruit pods are subjected to a deep-freezing.

10. The method of claim 1, wherein, prior to step a), the fruit pods are subjected to at least an initial fermentation.

11. The method of claim 1, wherein, prior to step a), the fruit pods are milled.

12. The method of claim 1, wherein, prior to step a), the fruit pods are shaken.

13. The method of claim 1, wherein said treatment chamber is subjected to movement.

14. The method of claim 1, wherein said fruit pods are initially thrown against a peripheral wall of said treatment chamber and against one other for an extended period of time while in a closed state maintained by means of suitable adjustment of a low drying temperature and a revolution speed of said treatment chamber prior to exposing seed hairs via opening pods to enhanced release of seeds from seed hairs.

15. A device for obtaining a fiber material suitable as a raw material for insulation purposes and for the manufacture of non-woven materials, the device comprising:

means for introducing fruit pods of at least one of poplar, willow, fruit hair developing plants, Bombacacea, cotton, cotton-type epilobium strains, fruit having hairy outgrowths from inner walls thereof, composites, and similar plants into a treatment chamber;

means for flowing air through said treatment chamber to dry said fruit pods; and means for moving said fruit pods in said treatment chamber to substantially release fiber material from other constituents, wherein initially closed fruit pods open to expose fiber material contained therein.

16. The device of claim 15, wherein said treatment chamber is defined by an interior region of a rotating drum, said rotating drum having an axis of rotation which is one of horizontal and somewhat inclined at an angle with respect to horizontal, wherein said flowing air means comprise a drying device.

17. The device of claim 16, wherein said axis of rotation is located in a position inclined by a few degrees with respect to a horizontal plane.

18. The device of claim 16, further comprising at least one of fork-shaped and tine-shaped carrier ribs extending substantially parallel to said axis of rotation and projecting into said drum from a periphery thereof, wherein said fruit pods are lifted to pour downwardly.

19. The device of claim 18 further comprising loose solid bodies not rigidly connected to the device and disposed in said drum, said solid bodies impacting, due to movement during operation, against said fruit pods to support release of seed hairs from seed pods.

20. The device of claim 19, wherein said solid bodies comprise at least one of media located in said drum, paddles arranged in a rotatable manner, mixing elements, wooden spheres, filling substances with surfaces which are not hard, elastic solid bodies, cork, cork granulates, lightweight filling materials with hard surfaces, cereal grains, corn-cob elements, acorns, chestnuts, wood chippings, bark chippings, slivers, broken chips, limestone grit, shed limestone, lightweight minerals, swelling clay, and tufa.

21. The device of claim 16, further comprising at least one air inlet and at least one air outlet and with a separation device connected to said at least one air outlet.

22. The device of claim 21, wherein said separation device comprises a cyclone separator.

23. The device of claim 21, wherein said separation device comprises a separation chamber and at least one of a catchment device and a catchment net.

24. The device of claim 23, further comprising a suction blower disposed behind said at least one of said catchment device and said catchment net.

25. The device of claim 23, wherein said separation chamber has a horizontal dimension which is larger than a vertical dimension thereof, wherein, during operation, seed hairs and non-decontaminated material, dropping downwards, flow along separate paths and do not impede one another.

26. The device of claim 21, further comprising a connection channel leading to said separation device and with a non-rotating transition element disposed between said drum and said connection channel, said transition element having a diameter which is somewhat smaller than a diameter of said drum and substantially larger a diameter of said connection channel.

27. The device of claim 23, wherein said rotating drum has a drum radius which is greater than an axial drum length, wherein said drum has said air inlet for heated air and with said air outlet, wherein said air outlet is disposed to be one of in a middle of said drum and above a middle of said drum.

28. The device of claim 27, wherein said air outlet is connected to said separation chamber via a spiral connection channel.

29. The device of claim 23, further comprising a tube disposed in a transport path before an inlet into said separation chamber, said tube having internal walls which are at least one of corrugated, rough, and uneven.

30. The device of claim 23, further comprising a tube disposed in a path before an inlet into said separation chamber, said tube having obstacles in an interior thereof.

31. The device of claim 23, further comprising a tube disposed in a path before an inlet into said separation chamber, said tube having at least one of air flow turbulence means, a curved course, a spiral course, sudden changes of direction, and sudden changes in diameter.

* * * * *